US006103106A

United States Patent [19]

McVicker et al.

[11] Patent Number: 6,103,106

[45] **Date of Patent: *Aug. 15, 2000**

[54] DESULFURIZATION AND RING OPENING OF PETROLEUM STREAMS

[75] Inventors: Gary B. McVicker, Califon, N.J.; James J. Schorfheide, Baton Rouge, La.; William C. Baird Jr., Baton Rouge, La.; Michele S. Touvelle, Baton Rouge, La.; Michel Daage, Baton Rouge, La.; Darryl P. Klein, Baton Rouge, La.; Edward S. Ellis, Basking Ridge; David E.W. Vaughan, Flemington, both of N.J.; Jingguang Chen, Wilmington, Del.; Sylvain S. Hantzer, Prairieville, La.

[73] Assignee: Exxon Research and Engineering Company, Florham Park, N.J.

[ * ] Notice: This patent is subject to a terminal disclaimer.

[21] Appl. No.: 09/326,843

[22] Filed: Jun. 7, 1999

Related U.S. Application Data

[63] Continuation-in-part of application No. 08/917,070, Aug. 22, 1997, Pat. No. 5,928,498.

[51] Int. Cl.[7] ..... C10G 45/00

[52] U.S. Cl. ..... 208/213; 208/211; 208/212; 208/217; 208/226

[58] Field of Search ..... 200/213, 211, 200/212, 217, 226

[56] References Cited

U.S. PATENT DOCUMENTS 5,928,498 7/1999 Mc Vicker ..... 208/213

*Primary Examiner*—Helane E. Myers
*Attorney, Agent, or Firm*—Henry E. Naylor; Gerard J. Hughes

[57] ABSTRACT

A process for the hydrodesulfurization (HDS) of the multiple condensed ring heterocyclic organosulfur compounds and the ring opening of ring compounds present in petroleum and petrochemical streams. The process is conducted in the presence of hydrogen, one or more noble metal catalysts, and a hydrogen sulfide sorbent material.

25 Claims, No Drawings

DESULFURIZATION AND RING OPENING OF PETROLEUM STREAMS

CROSS REFERENCE TO RELATED APPLICATIONS

This is a continuation-in-part of U.S. Ser. No. 08/917,070 filed Aug. 22, 1997 now U.S. Pat. No. 5,928,498.

FIELD OF THE INVENTION

The present invention relates to a process for the hydrodesulfurization (HDS) of the multiple condensed ring heterocyclic organosulfur compounds and the ring opening of ring compounds present in petroleum and petrochemical streams. The process is conducted in the presence of hydrogen, one or more noble metal catalysts, and a hydrogen sulfide sorbent material.

BACKGROUND OF THE INVENTION

There is an increasing demand for environmentally friendly hydrocarbons and clean-burning high performance fuels, such as distillate fuels like diesel and jet fuels. Distillate fuels typically contain paraffins, naphthenes, and aromatics having greater than 9 carbon atoms. For fuel quality parameters such as cetane, gravity and emissions, paraffins are the most desirable components, followed by naphthenes, followed by aromatics. The least desirable are multi-ring aromatic compounds. While various refinery processes produce distillate fuels, these processes are typically limited in their capability to produce high quality distillate fuel and/or high yields of distillate fuel. For example, conventional hydrogenation processes saturate aromatic rings to naphthenes, thereby increasing the cetane number, and increasing the API gravity (lower density). The disadvantage of hydrogenation alone is that naphthenes have generally lower cetane values and are more dense than paraffins having substantially the same number of carbon atoms. The greater density of naphthenes results in reduced volume of the distillate fuel blend relative to a composition containing similar concentrations of paraffins instead of naphthenes. Similarly, multi-ring naphthenes are generally more dense and have lower cetane values than single-ring naphthenes having substantially the same number of carbon atoms. In addition, naphthenes can be converted to aromatics via oxidation reactions. Since combustion of naphthenes in fuels occurs under oxidizing conditions, there is the potential for naphthenes to revert to aromatics under combustion conditions, thus reducing fuel quality and increasing emissions of undesirable compounds. Consequently, it is desirable to ring open naphthenes to produce the corresponding paraffins. Conversion of naphthenes to paraffins, using noble metal catalysts, is known to produce fuels with higher cetane number and higher API gravity. A significant problem associated with the use of noble metal catalysts for ring opening is their deactivation in the presence of sulfur. Consequently, it would be advantageous to have a process which could integrate hydrodesulfurization with ring opening.

Hydrodesulfurization is one of the fundamental processes of the refining and petrochemical industries. The removal of feed sulfur by conversion to hydrogen sulfide is typically achieved by reaction with hydrogen over non-noble metal sulfides, especially those of Co/Mo and Ni/Mo, at fairly severe temperatures and pressures to meet product quality specifications, or to supply a desulfurized stream to a subsequent sulfur sensitive process. The latter is a particularly important objective because some processes are carried out over catalysts which are extremely sensitive to poisoning by sulfur. This sulfur sensitivity is sometimes sufficiently acute as to require a substantially sulfur free feed. In other cases environmental considerations and mandates drive product quality specifications to very low sulfur levels.

There is a well established hierarchy in the ease of sulfur removal from the various organosulfur compounds common to refinery and chemical streams. Simple aliphatic, naphthenic, and aromatic mercaptans, sulfides, di- and polysulfides and the like surrender their sulfur more readily than the class of heterocyclic sulfur compounds comprised of thiophene and its higher homologs and analogs. Within the generic thiophenic class, desulfurization reactivity decreases with increasing molecular structure and complexity. While simple thiophenes represent the more labile sulfur types the other extreme, which is sometimes referred to as "hard sulfur" or "refractory sulfur," is represented by the derivatives of dibenzothiophene, especially those mono- and di-substituted and condensed ring dibenzothiophenes bearing substituents on the carbons beta to the sulfur atom. These highly refractory sulfur heterocycles resist desulfurization as a consequence of steric inhibition precluding the requisite catalyst-substrate interaction. For this reason, these materials survive traditional desulfurization processes and poison subsequent processes whose operability is dependent upon a sulfur sensitive catalyst. Destruction of these "hard sulfur" types can be accomplished under relatively severe process conditions, but this may prove to be economically undesirable owing to the onset of harmful side reactions leading to feed and/or product degradation. Also, the level of investment and operating costs required to drive the severe process conditions may be too great for the required sulfur specification.

A recent review (M. J. Girgis and B. C. Gates, *Ind. Eng. Chem.,* 1991, 30, 2021) addresses the fate of various thiophenic types at reaction conditions employed industrially, e.g., 340–425° C. (644–799° F.), 825–2550 psig. For dibenzothiophenes the substitution of a methyl group into the 4-position or into the 4- and 6-positions decreases the desulfurization activity by an order of magnitude. These authors state, "These methyl-substituted dibenzothiophenes are now recognized as the organosulfur compounds that are most slowly converted in the HDS of heavy fossil fuels. One of the challenges for future technology is to find catalysts and processes to desulfurize them."

M. Houalla et al, *J. Catal.,* 61, 523 (1980) disclose activity debits of 1–10 orders of magnitude for similarly substituted dibenzothiophenes under similar hydrodesulfurization conditions. While the literature addresses methyl substituted dibenzothiophenes, it is apparent that substitution with alkyl substituents greater than methyl , e.g., 4,6-diethyldibenzothiophene, would intensify the refractory nature of these sulfur compounds. Condensed ring aromatic substituents incorporating the 3,4 and/or 6,7 carbons would exert a similar negative influence. Similar results are described by Lamure-Meille et al, Applied Catalysis A: General, 131, 143, (1995) based on similar substrates.

Mochida et al, Catalysis Today, 29, 185 (1996) address the deep desulfurization of diesel fuels from the perspective of process and catalyst designs aimed at the conversion of the refractory sulfur types, which "are hardly desulfurized in the conventional HDS process." These authors optimize their process to a product sulfur level of 0.016 wt. %, which reflects the inability of an idealized system to drive the conversion of the most resistant sulfur molecules to extinction. Vasudevan et al, Catalysis Reviews, 38, 161(1996) in a discussion of deep HDS catalysis report that while Pt and Ir catalysts were initially highly active on refractory sulfur species, both catalysts deactivated with time on oil.

In light of the above, there is a need for a desulfurization/ring-opening process capable of converting feeds bearing the refractory, condensed ring sulfur heterocycles at relatively mild process conditions to streams containing substantially no sulfur. Such streams will not deactivate the ring opening catalyst.

SUMMARY OF THE INVENTION

In accordance with the present invention there is provided a process for the desulfurization of condensed ring sulfur heterocyclic compounds and the ring-opening of ring compounds including aromatics and naphthenes, of a petroleum or petrochemical feedstream containing said compounds, which process comprises contacting said stream with a catalyst system comprised of: (a) one or more catalysts comprised of an effective amount of a noble metal selected from the group consisting of Pt, Pd, Ir, Ru, and Rh on an inorganic refractory support; and (b) a hydrogen sulfide sorbent material; at process conditions which include temperatures from about 40° C. to 500° C., and pressures from about 100 to 3,000 psig.

In a preferred embodiment of the present invention there is provided a first catalyst bed containing a catalyst comprised of a noble metal selected from the group consisting of Pt, Pd, Ir, and polymetallics thereof, on a refractory support; and a hydrogen sulfide sorbent material; and a second catalyst bed containing a ring-opening catalyst comprised of a noble metal selected from the group consisting of Pt, Pd, Ir, Ru, Rh, and polymetallics thereof.

In another preferred embodiment the noble metal of the ring opening catalyst is selected from the group consisting of Ir, Rh, and Ru.

In yet another preferred embodiment of the present invention the noble metal of the second catalyst is Ir and the inorganic refractory support is a zeolite.

In still another preferred embodiment of the present invention there is provided a process containing three beds; a first bed comprised of a noble metal selected from the group consisting of Ir, Pt, Pd, and polymetallics thereof, on a refractory support; a second bed downstream from said first bed comprised of a hydrogen sulfide sorbent material; and a third bed downstream from said second bed containing a ring-opening catalyst comprised of a noble metal selected from the group consisting of Pt, Pd, Ir, Ru, Rh, and polymetallics thereof.

In another preferred embodiment of the present invention there is provided one catalyst bed containing one or more catalysts comprised of a noble metal selected from the group consisting of Ir, Pt, Pd, and polymetallics thereof, and a hydrogen sulfide sorbent.

In yet another preferred embodiment of the present invention, at least one of the catalyst in the process has an aromatic saturation function.

In another preferred embodiment of the present invention, the hydrogen sulfide sorbent is selected from supported and unsupported metal oxides, spinels, zeolitic based materials, and layered double hydroxides.

DETAILED DESCRIPTION OF THE INVENTION

Feedstocks suitable for being treated by the present invention are those petroleum based feedstocks which contain condensed ring sulfur heterocyclic compounds, as well as other ring compounds, including multi-ring aromatic and naphthenic compounds. Such compounds are typically found in petroleum streams boiling in the distillate range and above. Non-limiting examples of such feeds include diesel fuels, jet fuels, heating oils, and lubes. Such feeds typically have a boiling range from about 150 to about 600° C., preferably from about 175 to about 400° C. It is preferred that the streams first be hydrotreated to reduce sulfur contents, preferably to less than about 500 wppm, more preferably to less than about 200 wppm, most preferably to less than about 100 wppm sulfur, ideally to less than about 50 wppm. It is highly desirable for the refiner to upgrade these types of feedstocks by removing as much of the sulfur as possible, as well as to open ring compounds to produce paraffins.

It is well known that so-called "easy" sulfur compounds, such as non-thiophenic sulfur compounds, thiophenes, benzothiophenes, and non-beta dibenzothiophenes can be removed without using severe process conditions. The prior art teaches that substantially more severe conditions are needed to remove the so-called "hard" sulfur compounds, such as condensed ring sulfur heterocyclic compounds which are typically present as 3-ring sulfur compounds, such as beta and di-beta dibenzothiophenes. An example of a typical three ring "hard" sulfur compound found in petroleum streams is 4,6-diethyldibenzothiophene. While the desulfurization process of the present invention is applicable to all sulfur bearing compounds common to petroleum and chemical streams, it is particularly suitable for the desulfurization of the least reactive, most highly refractory sulfur species, particularly the class derived from dibenzothiophenes, and most especially the alkyl, aryl, and condensed ring derivatives of this heterocyclic group, particularly those bearing one or more substituents in the 3-, 4-, 6-, and 7-positions relative to the thiophenic sulfur. The process of the present invention will result in a product stream with substantially no sulfur. For purposes of this invention, the term, "substantially no sulfur", depends upon the overall process being considered, but can be defined as a value less than about 1 wppm, preferably less than about 0.5 wppm, more preferably less than about 0.1 wppm, and most preferably less than about 0.01 wppm as measured by existing, conventional analytical technology. It is important that the sulfur levels be as low as possible because the noble metal ring-opening catalysts are susceptible to deactivation, even at relatively low sulfur levels.

It is also known in the art that ring compounds can be opened by use of noble metal supported catalysts. It has surprisingly been found by the inventors hereof that streams containing a significant amount of "hard sulfur" can be desulfurized at relatively mild conditions and either simultaneously, or subsequently subjected to ring opening with a noble metal supported catalyst.

The catalyst system of the present invention contains: 1) a hydrodesulfurization (HDS) function, 2) a hydrogen sulfide sorbent function, and 3) a ring opening function. A component having an aromatics saturation (ASAT) function may also be used if needed to meet product quality objectives, or to enhance the ring-opening step. Both the HDS function and the ring-opening function may be provided by the same catalyst or on a different catalyst. It is also possible that two or more of these functions, HDS, ASAT, and ring opening, be provided by the same catalyst.

It is important for the practice of the present invention that the ring-opening step be conducted in a relatively hydrogen sulfide free environment. This is achieved by the HDS function of the catalyst, which converts organosulfur compounds to hydrogen sulfide, and the hydrogen sulfide sorbent material that absorbs the hydrogen sulfide before it can deactivate the noble metal catalyst.

The HDS function and the ASAT function of this process are preferably achieved by use of a Ir, Pt or Pd based catalyst, wherein said metals are supported in a highly dispersed and uniformly distributed manner on a refractory inorganic support. Various promoter metals may also be incorporated for purposes of selectivity, activity, and stability improvement. Non-limiting examples of such promoters that may be used herein include those selected from the group consisting of Re, Cu, Ag, Au, Sn, Zn, and the like.

Suitable support materials for the catalysts and hydrogen sulfide sorbents of the present invention include inorganic, refractory materials such as alumina, silica, silicon carbide, amorphous and crystalline silica-aluminas, silica-magnesias, aluminophosphates boria, titania, zirconia, and mixtures and cogels thereof. Preferred supports include alumina and the crystalline silica-aluminas, particularly those materials classified as clays or zeolitic materials, and more preferably controlled acidity zeolitic materials, including aluminophosphates, and modified by their manner of synthesis, by the incorporation of acidity moderators, and post-synthesis modifications such as demetallation and silylation. For purposes of this invention particularly desirable zeolitic materials are those crystalline materials having micropores and include conventional zeolitic materials and molecular sieves, including aluminophosphates and suitable derivatives thereof. Such materials also include pillared clays and layered double hydroxides.

The noble metals may be loaded onto these supports by conventional techniques known in the art. These include impregnation by incipient wetness, by adsorption from excess impregnating medium, or by ion exchange. The metal bearing catalysts are typically dried, calcined, and reduced; the latter may either be conducted ex situ or in situ as preferred. The catalysts are not presulfided as the presence of sulfur is not essential to HDS or ASAT activity and activity maintenance. However, in some cases the sulfided form of the catalyst may be employed without harm and may be preferred if the absence of catalyst sulfur contributes to the loss of selectivity or to decreased stability. If sulfiding is desired, then it can be accomplished by exposure to dilute hydrogen sulfide in hydrogen or by exposure to a sulfur containing hydrocarbon feed until sulfur breakthrough is observed.

Total metal loading for noble metal based HDS and ASAT catalysts is in the range of about 0.01 to 5 wt. %, preferably to 0.1 to 2 wt. %, and more preferably to 0.15 to 2 wt. %. For polymetallic noble metal catalysts similar ranges are applicable to each component; however, the bimetallics may be either balanced or unbalanced where the loadings of the individual metals may either be equivalent, or the loading of one metal may be greater or less than that of its partner. The loading of stability and selectivity modifiers ranges from 0.01 to 2 wt. %, preferably 0.02 to 1.5 wt. %, and more preferably 0.03 to 1.0 wt. %. The catalysts may or may not contain chloride and sulfur. Chloride levels range from 0.3 to 2.0 wt. %, preferably 0.5 to 1.5 wt. %, and more preferably 0.6 to 1.2 wt. %. Sulfur loadings of the noble metal catalysts approximate those produced by breakthrough sulfiding of the catalyst and range from 0.01 to 1.2 wt. %, preferably 0.02 to 1.0 wt. %.

The hydrogen sulfide sorbent of this invention may be selected from several classes of material known to be reactive toward hydrogen sulfide and capable of binding same in either a reversible or irreversible manner. Metal oxides are useful in this capacity and may be employed as the bulk oxides or may be supported on an appropriate support material such as an alumina, silica, or a zeolite, or mixtures thereof. Representative metal oxides include those of the metals from Groups IA, IIA, IB, IIB, IIIA, IVA, VB, VIB, VIIB, VIII of the Periodic Table of the Elements. The Periodic Table of the Elements referred to herein is that published by Sargent-Welch Scientific Company, Catalog No. S-18806, Copyright 1980. Representative elements include Zn, Fe, Ni, Cu, Mo, Co, Mg, Mn, W, K, Na, Ca, Ba, La, V, Ta, Nb, Re, Zr, Cr, Ag, Sn, and the like. The metal oxides may be employed individually or in combination. The preferred metal oxides are those of Ba, K, Ca, Zn, Co, Ni, and Cu. Representative supported metal oxides include ZnO on alumina, CuO on silica, ZnO/CuO on kieselguhr, and the like. Compounds of the Group IA and IIA metals capable of functioning as hydrogen sulfide sorbents include, in addition to the oxides, the hydroxides, alkoxides, and sulfides. These systems are disclosed in the following patents of Baird et al. incorporated herein by reference: U.S. Pat. No. 4,003,823; U.S. Pat. No. 4,007,109; U.S. Pat. No. 4,087,348; U.S. Pat. No. 4,087,349; U.S. 4,119,528; U.S. Pat. No. 4,127,470.

Spinels represent another class of hydrogen sulfide sorbents useful in this invention. These materials are readily synthesized from the appropriate metal salt, frequently a sulfate, and sodium aluminate under the influence of a third agent like sulfuric acid. Spinels of the transition metals listed above may be utilized as effective, regenerable hydrogen sulfide sorbents; zinc aluminum spinel, as defined in U.S. Pat. No. 4,263,020, incorporated herein by reference, is a preferred spinel for this invention. The sulfur capacity of spinels may be promoted through the addition of one or more additional metals such as Fe or Cu as outlined in U.S. Pat. No. 4,690,806, which is incorporated herein by reference.

Zeolitic materials may serve as hydrogen sulfide sorbents for this invention as detailed in U.S. Pat. Nos. 4,831,206 and -207, which is incorporated herein by reference. These materials share with spinels the ability to function as regenerable hydrogen sulfide sorbents and permit operation of this invention in a mode cycling between sulfur capture and sulfur release in either continuous or batch operation depending upon the process configuration. Zeolitic materials incorporating sulfur active metals by ion exchange are also of value to this invention. Examples include Zn4A, chabazite, and faujasite moderated by the incorporation of zinc phosphate, and transition metal framework substituted zeolites similar to, but not limited to, U.S. Pat. No. 5,185,135/6/7 and U.S. Pat. No. 5,283,047, and continuations thereof, all incorporated herein by reference.

Various derivatives of hydrotalcite (often referred to as LDH, layered double hydroxides) exhibit high sulfur capacities and for this reason serve as hydrogen sulfide sorbents for this invention. Specific examples include $Mg_{4.8}Al_{1.2}(OH)_{12}Cl_{1.2}$, $Zn_4Cr_2(OH)_{12}Cl_2$, $Zn_4Al_2(OH)_{12}Cl_2$, $Mg_{4.5}Al_{1.5}(OH)_{12}Cl_{1.5}$, $Zn_4Fe_2(OH)_{12}C_{12}$, and $Mg_4Al_2(OH)_{12}Cl_3$ and may include numerous modified and unmodified synthetic and mineral analogs of these as described in U.S. Pat. No. 3,539,306, U.S. Pat. No. 3,796,792, U.S. Pat. No. 3,879,523, and U.S. Pat. No. 4,454,244, and reviewed by Cavani et al. in *Catalysis* Today, Vol. 11, No. 2, pp. 173–301 (1991), all of which are incorporated herein by reference. Particularly active hydrogen sulfide sorbents are LaRoach H-T, $ZnSi_2O_5$ gel, $Zn_4Fe_2(OH)_{12}Cl_2$, and the Fe containing clay, nontronite. A study of several Mg—Al hydrotalcites demonstrated a preference for crystallites less than about 300 Angstroms. Particularly novel are pillared varieties of smectites, kandites, LDHs and silicic acids in which the layered structure is pillared by oxides of Fe, Cr, Ni, Co, and Zn, or such oxides in combination with alumina as demonstrated by, but not limited to, U.S. Pat. No. 4,666,877, U.S. Pat. No. 5,326,734, U.S. Pat. No. 4,665,044/5 and Brindley et al, *Clays And Clay Minerals,* 26, 21 (1978) and *Amer. Mineral,* 64, 830 (1979), all incorporated herein by reference. The high molecular dispersions of the reactive metal make them very effective scavengers for sulfur bearing molecules. A preferred class of hydrogen sulfide sorbents are those which are regenerable as contrasted to those which bind sulfur irreversibly in a stoichiometric reaction. Hydrogen sulfide sorbents which bind sulfur through physical adsorption are generally regenerable through manipulation of the process temperature, pressure, and/or gas rate so that the sorbent may cycle between adsorption and desorption stages.

A preferred class of hydrogen sulfide sorbents are those which are regenerable as contrasted to those which bind sulfur irreversibly in a stoichiometric reaction. Hydrogen sulfide sorbents which bind sulfur through physical adsorption are generally regenerable through manipulation of the process temperature, pressure, and/or gas rate so that the sorbent may cycle between adsorption and desorption stages. Representative of such sorbents are zeolitic materials, spinels, meso-. and microporous transition metal oxides, particularly oxides of the fourth period of the Periodic Chart of the Elements.

Hydrogen sulfide sorbents which bind sulfur through a chemisorptive mechanism may also be regenerated by the use of reactive agents through which the sulfur bearing compound is reacted and restored to its initial, active state. Reagents useful for the regeneration of these types of hydrogen sulfide sorbents are air (oxygen), steam, hydrogen, and reducing agents such as carbon and carbon monoxide. The choice of regenerating agent is determined by the initial, active state of the sorbent and by the chemical intermediates arising during the regeneration procedure. Active hydrogen sulfide sorbents regenerable by reaction with oxygen include the oxides of manganese, lanthanum, vanadium, tantalum, niobium, molybdenum, rhenium, zirconium, chromium, and mixtures thereof. Active hydrogen sulfide sorbents regenerable through reaction with steam, either alone or in combination with oxygen, include the oxides of lanthanum, iron, tin, zirconium, titanium, chromium, and mixtures thereof. Active hydrogen sulfide sorbents regenerable through the sequential action of hydrogen and oxygen include the oxides of iron, cobalt, nickel, copper, silver, tin, rhenium, molybdenum, and mixtures thereof. Active hydrogen sulfide sorbents regenerable through the action of hydrogen include iron, cobalt, nickel, copper, silver, mercury, tin, and mixtures thereof. In addition all transition metal oxides are regenerable from their corresponding sulfates by reduction with hydrogen, carbon, or carbon monoxide. These regeneration reactions may be facilitated by the inclusion of a catalytic agent that facilitates the oxidation or reduction reaction required to restore the sulfur sorbent to its initial, active condition.

In addition, of particular interest as regenerable hydrogen sulfide sorbents are two classes of materials: zeolitic materials enriched in the alkali metals of Group IA; the high surface area, porous materials represented by zeolite-like structures, nonstoichiometric basic oxides of the transition metals, reviewed in part by Wadsley (Nonstoichiometric Compounds, edited by Mandelkom, Academic Press, 1964) and numerous surfactant templated metal oxide materials analogous to MCM-41 type structures as disclosed in U.S. Pat. No. 5,057,296 incorporated herein by reference.

These regeneration processes operate over a temperature range of 100–700° C., preferably 150–600° C., and more preferably 200–500° C. at pressures comparable to those cited below in the general disclosure of process conditions common to this invention.

The ring opening catalyst of this invention may contain either a metal function alone or a metal function combined with an acid function. The metal function will be comprised of an effective amount of a noble metal selected from Pt, Pd, Ir, Ru, Rh, and mixtures and polymetallics thereof. Preferred are Ir, Rh, and Ru and more preferred is Ir. Typically, an effective amount of noble metal would be up to about 10 wt. %, based on the total weight of the catalyst. Preferably the amount of metal would be from about 0.01 wt. % to about 5 wt. %, more preferably from about 0.02 wt. % to 3 wt. %, and most preferably from about 0.1 wt. % to 1 wt. %. If used, an effective amount of acid function would be that amount needed to cause isomerization of $C_6$ naphthenic rings to $C_5$ naphthenic rings, but not so much as to cause excessive cleavage of substituents from the ring and/or secondary cracking. The precise amount of acidity to balance isomerization versus cleavage of ring substituents depends on many factors, such as the molecular make-up of the feed, the process conditions, and the particular catalyst employed. Ring opening catalysts useful to this invention are disclosed in U.S. Ser. No. 08/523,300, filed Sep. 5, 1995; and U.S. Ser. No. 08/631,472, filed Apr. 12, 1996; incorporated herein by reference.

Ring opening will impact the fuel characteristics of these feedstocks by reducing the number of ring structures in the product stream and increasing volume swell by lowering the density of the product stream. It is preferred that the ring opening employed herein be selective. For purposes of this invention, selective ring opening means a high propensity for cleavage of a ring bond which results in product molecules having substantially the same number of carbon atoms and one less ring than the original molecule, thus avoiding significant dealkylation of any pendant substituents on rings which will reduce the volume of product in a specified boiling range.

Molecular classes may be ranked in terms of their cetane number for a specific carbon number: normal paraffins have the highest cetane number followed by normal olefins, isoparaffins, and by monocyclic naphthenes. Aromatic molecules, particularly multi-ring aromatics, have the lowest cetane numbers. For example, naphthalene has a cetane blending number of about 5–10; tetrahydronaphthalene (tetralin) about 15, decahydronaphthalene (decalin) about 35–38, butylcyclohexane about 58–62, and decane about 72–76. These cetane measurements are consistent with the trend for higher cetane value with increasing ring saturation and ring opening.

Various catalyst bed configurations may be used in the practice of the present invention with the understanding that the selection of a specific configuration is tied to specific process objectives. A bed configuration wherein the hydrogen sulfide sorbent is placed upstream of the HDS catalyst is not a configuration of the present invention. Likewise, a bed configuration wherein the ring opening catalyst is placed upstream of the hydrogen sulfide sorbent is also excluded.

Since the preferred HDS catalysts used in conjunction with the hydrogen sulfide sorbent can simultaneously provide an ASAT function in the systems described below, the HDS catalysts will hereafter be designated as HDS/ASAT catalysts.

One bed configuration employs a stacked bed, as the HDS/ASAT catalyst is stacked, or layered, above and upstream of the hydrogen sulfide sorbent. The stacked bed may either occupy a common reactor, or the HDS/ASAT catalyst may occupy a separate reactor upstream of the vessel containing the hydrogen sulfide sorbent. This dedicated reactor sequence is preferred when it is desirable to operate the HDS/ASAT catalyst and the hydrogen sulfide sorbent at substantially different reactor temperatures or to facilitate frequent or continuous replacement of the hydrogen sulfide sorbent material. This bed configuration would then be followed by the ring opening catalyst, either occupying a common reactor or a separate reactor downstream. A separate reactor is preferred when it is desirable to operate the ring opening catalyst at a substantially different temperature than the HDS/ASAT and hydrogen sulfide sorbent reactor(s).

A second configuration employs a mixed bed, as particles of the HDS/ASAT catalyst are intimately intermixed with those of the hydrogen sulfide sorbent. This bed configuration would then be followed by the ring opening catalyst, either occupying a common reactor or a separate reactor downstream. A separate reactor is preferred when it is desirable to operate the ring opening catalyst at a substantially different temperature than the HDS/ASAT/hydrogen sulfide sorbent reactor or to facilitate the replacement of the HDS/ASAT catalyst and/or the hydrogen sulfide sorbent.

Materials can also be formulated which allow one or more of the various catalytic functions of the instant invention (i.e., HDS, ASAT and ring opening) and the hydrogen sulfide sorbent function to reside on a common particle. In one such formulation, the HDS/ASAT and hydrogen sulfide sorbent components are blended together to form a composite particle. For example, a finely divided, powdered Pt on alumina catalyst is uniformly blended with zinc oxide powder and the mixture formed into a common catalyst particle, or zinc oxide powder is incorporated into the alumina mull mix prior to extrusion, and Pt is impregnated onto the zinc oxide-containing alumina in a manner similar to that described in U.S. Pat. No. 4,963,249, which is incorporated herein by reference.

Another formulation is based on the impregnation of a support with a HDS/ASAT-active metal salt (e.g., Pt) and a hydrogen sulfide sorbent-active salt (e.g., Zn) to prepare a bimetallic catalyst incorporating the HDS/ASAT metal and the hydrogen sulfide sorbent on a common base. For example, a Pt—Zn bimetallic may be prepared in such a manner as to distribute both metals uniformly throughout the extrudate, or, alternatively, the Zn component may be deposited preferentially in the exterior region of the extrudate to produce a rim, or eggshell, Zn rich zone, or the Pt component may be deposited preferentially in the exterior region of the extrudate to produce a rim, or eggshell, Pt rich zone. These are often referred to as "cherry" structures.

If the formulation does not provide for a ring opening function, it would then be followed by the ring opening catalyst, either occupying a common reactor or a separate reactor downstream. A separate reactor is preferred when it is desirable to operate the ring opening catalyst at a substantially different temperature than the HDS/ASAT/hydrogen sulfide sorbent catalyst. If the composite formulation does contain a ring opening function, the use of a ring opening catalyst after the composite catalyst is optional, and said use would be dictated by specific process conditions and product quality objectives.

Since ring opening is enhanced by saturation of aromatic compounds to naphthenes, a stand-alone ASAT catalyst can be inserted directly upstream of the ring opening catalyst in either of the configurations described above. The stand-alone ASAT catalyst could occupy a common reactor or separate reactor. A separate reactor would be preferred if it is advantageous to operate the stand-alone ASAT catalyst at a substantially different temperature than the HDS/ASAT catalyst and hydrogen sulfide sorbent preceding it. The HDS/ASAT catalyst and the stand-alone ASAT catalyst may or may not be the same material.

Noble metal ring opening catalysts may also simultaneously provide HDS and ASAT functions. Mixed bed configurations, as described above, allow operation in this mode. If this configuration is employed, the use of a ring opening catalyst after a mixed bed is optional, and said use would be dictated by specific process conditions and product quality objectives. If employed, the ring opening catalyst downstream may or may not be the same material as that used in the mixed bed. It is also within the scope of the present invention that an HDS catalyst, an ASAT catalyst, a ring opening catalyst, and a hydrogen sulfide sorbent can all be present in a single mixed bed.

In any of the configurations described above, the ring opening catalyst can be mixed with a hydrogen sulfide sorbent to protect against unintended exposure to hydrogen sulfide in case of unit upset. Likewise, in any of the configurations described above, the catalyst components may share similar or identical shapes and sizes, or the particles of one may differ in shape and/or size from the others. The later relationship is of potential value should it be desirable to affect a simple physical separation of the be components upon discharge or reworking. Additionally, the hydrogen sulfide sorbent material can be sized to allow sorbent particles to flow with the feedstream through a fixed bed of any combination of catalyst. For example, a bed of HDS/ASAT catalysts, or a bed of HDS/ASAT/ring opening catalysts, or a bed of ASAT/ring opening catalyst, moving with the liquid phase. In any of the stacked bed configurations wherein the hydrogen sulfide sorbent material is contained in a separate reactor, swing reactors can be employed such that one hydrogen sulfide sorbent reactor is always on-stream.

The composition of the sorbent bed is independent of bed configuration and may be varied with respect to the specific process, or integrated process, to which the present invention is applied. In those instances where the capacity of the hydrogen sulfide sorbent is limiting, the composition of the hydrogen sulfide sorbent must be consistent with the expected lifetime, or cycle, of the process. These parameters are in turn sensitive to the sulfur content of the feed being processed and to the degree of desulfurization desired. For these reasons the composition of the guard bed is flexible and variable, and the optimal bed composition for one application may not serve an alternative application equally well. In general, the weight ratio of the hydrogen sulfide sorbent to the total weight of catalyst may range from 0.01 to 1000, preferably from 0.5 to 500, more preferably from about 0.5 to 100, most preferably from about 0.5 to 40, especially preferred from about 0.7 to 30. For three component configurations the ranges cited apply to the mixed zone of the mixed/stacked arrangement and to the first two zones of the stacked/stacked/stacked design. The HDS/ASAT catalyst present in the final zone of these two arrays is generally present at a weight equal to, or less than, the combined weight compositions of the upstream zones.

The process of this invention is operable over a range of conditions consistent with the intended objectives in terms of product quality improvement. It is understood that hydrogen is an essential component of the process and may be supplied pure or admixed with other passive or inert gases as is frequently the case in a refining or chemical processing environment. It is preferred that the hydrogen stream be sulfur and ammonia free, or essentially sulfur-free, and it is understood that the latter condition may be achieved if desired by conventional technologies currently utilized for this purpose. In general, the conditions of temperature and pressure are significantly mild relative to conventional hydroprocessing technology, especially with regard to the processing of streams containing the refractory sulfur types as herein previously defined. This invention is commonly operated at conditions that favor aromatic hydrogenation as opposed to conditions that favor reforming. Included is a temperature of 40–425° C. (104–797° F.) and preferably 225–400° C. (437–752° F.). Operating pressure includes 0–3000 psig, preferably 100–2,200 psig, and more preferably 100–1,000 psig at gas rates of 50–10,000 SCF/B (standard cubic feet per barrel), preferably 100–7,500 SCF/B, and more preferably 500–5,000 SCF/B. The feed rate may be varied over the range 0.1–100 LHSV (liquid hourly space velocity), preferably 0.3–40 LHSV, and more preferably 0.5–30 LHSV.

This invention is illustrated by, but not limited to, the following examples. The efficacy of the process of this invention is assessed through the use of a highly sulfur sensitive reaction, the opening of naphthenic rings by Ir containing catalysts.

EXAMPLE 1

A 0.9 wt. % Ir catalyst was prepared by impregnating alumina with a standardized solution of chloroiridic acid. The catalyst was dried, mildly calcined in air, and reduced in hydrogen. The catalyst was evaluated as a ring opening catalyst to convert methylcyclohexane to the acyclic $C_7$ isomers, n-heptane, and 2-, and 3-methylhexanes. The course of the ring opening reaction as a function of time was followed using methylcyclohexane conversion and the total rate of formation of the isomeric heptanes as measures. The results of this model reaction appear in Table 1.

EXAMPLE 2

The Ir catalyst of Example 1 was evaluated for ring opening of methylcyclohexane to which 5 wppm sulfur had been added as thiophene. The results of this experiment appear in Table 1. Comparison of Example 1 with Example 2 reveals an acute sensitivity to sulfur poisoning by the Ir catalyst as all ring opening activity is essentially lost within 20 hr on oil.

EXAMPLE 3

A stacked catalyst bed consisting of 3 g of zinc oxide on top of 2 g of the Ir catalyst of Example 1, the two zones separated by a bed of mullite beads, was evaluated for the ring opening of methylcyclohexane containing 5 wppm sulfur as thiophene. The Ir catalyst charge was equivalent to those of Examples 1 and 2. The feed flow to the reactor was downstream so that the sulfur containing feed contacted the zinc oxide initially. The results of this experiment appear in Table 1. Deactivation of the Ir catalyst was similar to that of Example 2 indicating that zinc oxide by itself has no influence on the sulfur poisoning of the downstream Ir ring opening catalyst.

EXAMPLE 4

The procedure of Example 3 was repeated except that the zinc oxide particles and the Ir catalyst particles were combined to form an intimate mixture. This mixed bed was evaluated for ring opening activity on methylcyclohexane containing 5 wppm sulfur as thiophene. The results appear in Table 1. This mixed bed in which the Ir catalyst functioned as a hydrodesulfurization and a ring opening catalyst in the presence of a hydrogen sulfide sorbent illustrates the protection of a highly sulfur sensitive ring opening catalyst by the process of this invention. The activity of this catalyst was maintained for 100 hr on oil when the test was arbitrarily terminated.

EXAMPLE 5

A mixed sulfur guard bed was prepared in which 1 g of a catalyst comprised of 0.6 wt. % Pt on alumina was admixed with 2 g of zinc oxide. Downstream of this guard bed was placed 2 g of the Ir ring opening catalyst of Example 1; the overall configuration is the mixed/stacked type with the two zones separated by mullite beads. This catalyst array was evaluated for ring opening of methylcyclohexane containing 5 wppm sulfur as thiophene, and the results appear in Table 1. The data show that the mixed guard bed upstream of the Ir ring opening catalyst effectively protected the latter from sulfur poisoning.

TABLE 1

Ring Opening Of Methylcyclohexane In The Presence Of Sulfur
Methylcyclohexane, 275° C., 400 psig, 7.7 W/H/W, $H_2$/Oil = 5

| Example | Sulfur, wppm | Catalyst | Conversion, Wt. % @ Hr On Oil | | | Ring Opening Rate[2] @ Hr ON Oil | | |
|---|---|---|---|---|---|---|---|---|
| | | | 10 | 20 | 40 | 10 | 20 | 40 |
| 1 | 0 | Ir | 20.1 | 19.2 | 19.3 | 14.1 | 13.5 | 13.3 |
| 2 | 5 | Ir | 14.0 | 1.4 | 0.0 | 9.7 | 0.8 | 0.0 |
| 3 | 5 | ZnO/Ir | 21.7 | 6.3 | 0.0 | 15.4 | 4.4 | 0.0 |
| 4 | 5 | ZnO + Ir | 19.7 | 17.0 | 18.8 | 13.8 | 12.0 | 13.1 |
| 5 | 5 | 0.9 Pt + ZnO/Ir | 20.7 | 18.0 | 19.0 | 14.3 | 12.5 | 13.1 |

[1]Ring Opening Rate = mol./g./hr.

EXAMPLE 6

A mixed sulfur guard bed was prepared by blending 1 g of a catalyst comprised of 0.6 wt. % Pt on alumina with 2 g of zinc oxide. This mixture was layered above a 2 g bed of the Ir ring opening catalyst of Example 1 to provide a mixed/stacked configuration. This system was evaluated for the ring opening of methylcyclohexane containing 5 wppm sulfur as thiophene and 10 wppm sulfur as 4,6-diethyldibenzothiophene. The results of this experiment appear in Table 2. The results demonstrate that the mixed guard bed upstream of the ring opening catalyst protected the latter from deactivation by sulfur poisoning. Comparison of Examples 5 and 6 shows that the system is capable of desulfurizing a feed rich in a refractory sulfur compound under mild hydrodesulfurization conditions.

EXAMPLE 7

The procedure of Example 6 was followed except that the metal content of the Pt catalyst admixed with zinc oxide was decreased to 0.05 wt. %. This variation was evaluated for the ring opening of the 15 wppm sulfur methylcyclohexane feed of Example 6, and the results in Table 2 demonstrate the insensitivity of the process of this invention to metal loading while retaining the ability to hydrodesulfurize a refractory sulfur compound at mild conditions.

EXAMPLE 8

The procedure of Example 6 was repeated except that the Pt catalyst admixed with the zinc oxide was a catalyst comprised of 0.3 wt. % Pt on alumina that had been reduced and sulfided. This system was tested for ring opening activity on the 15 wppm sulfur feed of Example 6. The results in Table 2 illustrate that the process of this invention may be operated on a sulfided catalyst if desired without harm. The data also reinforce the insensitivity of the process to metal loading in the guard and the ability to process a refractory sulfur compound at mild conditions independent of the state of sulfidation of the hydrodesulfurization catalyst.

TABLE 2

Ring Opening Of Methylcyclohexane Containing 5 wppm Sulfur As Thiophene And 10 wppm Sulfur As 4,6-Diethyldibenzothiophene Methylcyclohexane, 275° C., 400 psig, 7.7 W/H/W, $H_2$/Oil = 6

| | | Conversion, Wt. % @ Hr On Oil | | | Ring Opening Rate[1] @ Hr On Oil | | |
|---|---|---|---|---|---|---|---|
| Example | Catalyst | 10 | 20 | 100 | 10 | 20 | 100 |
| 6 | 0.6 Pt + ZnO/Ir | 14.8 | 14.3 | 13.0 | 10.4 | 10.0 | 9.1 |
| 7 | 0.05 Pt + ZnO/Ir | 27.1 | 24.2 | 20.9 | 18.6 | 16.8 | 14.5 |
| 8 | 0.3 PtS + ZnO/Ir | 15.0 | 13.6 | 12.1 | 10.6 | 9.5 | 8.3 |

[1]Ring Opening Rate = mol./g./hr.

EXAMPLE 9

The procedure of Example 6 was followed to prepare a mixed/stacked catalyst bed comprising 0.6 wt. % Pt on alumina commingled with zinc oxide upstream of the Ir ring opening catalyst. This system was evaluated for the ring opening of methylcyclohexane containing 50 wppm sulfur as 4,6-diethyldibenzothiophene. The results in Table 3 establish the retention of stable ring opening activity for an extended period of operation on this sulfur rich feed and on this highly refractory sulfur compound, which is being hydrodesulfurized over a noble metal catalyst at mild conditions.

EXAMPLE 10

The procedure of Example 9 was followed except that the Pt catalyst and the zinc oxide were not commingled but were arranged so that the Pt layer was above that of zinc oxide and separated by mullite beads, and that the complete catalyst bed was of the stacked/stacked/stacked variety. As Table 3 illustrates, this system was equally effective for sustaining ring opening activity on the methylcyclohexane feed containing 50 wppm sulfur as 4,6-diethyldibenzothiophene.

EXAMPLE 11

The procedure of Example 9 was followed except that a 1 wt. % Pd catalyst on alumina, prepared by the impregnation of alumina with a standardized palladium chloride solution, replaced the 0.6 wt. % Pt catalyst in the mixed bed preceding the Ir ring opening catalyst. The data of Table 3 confirm the utility of the Pd catalyst for the process of this invention.

EXAMPLE 12

The procedure of Example 10 was followed except that the Pd catalyst was substituted for the Pt catalyst in the stacked guard bed configuration. The data of Table 3 show that the Pd catalyst in the stacked bed configuration is deactivated over time by sulfur in contrast to Examples 11 and 12. The results illustrate the non-equivalency of Group VIII metals and the dependency of activity maintenance on bed configuration.

TABLE 3

Ring Opening Of Methylcyclohexane Containing 50 wppm Sulfur As 4,6-Diethyldibenzothiophene Methylcyclohexane, 275° C., 400 psig, 7.7 W/H/W, $H_2$/Oil = 6

| | | Conversion, Wt. % @ Hr On Oil | | | Ring Opening Rate[1] @ Hr On Oil | | |
|---|---|---|---|---|---|---|---|
| Example | Catalyst | 50 | 100 | 250 | 50 | 100 | 250 |
| 9 | Pt + ZnO/Ir | 16.9 | 15.6 | 15.3 | 11.8 | 11.0 | 10.8 |
| 10 | Pt/ZnO/Ir | 18.5 | 18.2 | 14.7 | 13.1 | 12.7 | 10.3 |
| 11 | Pd + ZnO/Ir | 21.6 | 20.9 | 19.3 | 15.2 | 14.8 | 13.5 |
| 12 | Pd/ZrO/Ir | 31.3 | 26.1 | 7.5 | 21.6 | 18.1 | 3.0 |

[1]Ring Opening Rate = mol./g./hr.

EXAMPLE 13

A bimetallic 0.3 wt. % Pt—0.3 wt. % Zn catalyst was prepared by impregnating alumina with standardized solutions of chloroplatinic acid and zinc nitrate. The catalyst was dried, calcined, and reduced. The procedure of Example 9 was followed except the bimetallic Pt—Zn catalyst replaced the 0.6 wt. % Pt catalyst in the mixed bed preceding the Ir catalyst. The results are shown in Table 4 below. The data show that the activity of the Pt hydrodesulfurization catalyst was not sensitive to the presence of Zn even though both metals were uniformly distributed throughout the catalyst.

EXAMPLE 14

A composite catalyst was prepared by commingling and blending a powdered 0.6 wt. % Pt on alumina catalyst with a powdered zinc oxide in a weight ratio of 1:2.2. The composite blend was formed into catalyst particles, and the catalyst was staged upstream of an Ir catalyst and tested as described in Example 9. The results presented in Table 4 demonstrate that the composite Pt—ZnO composite catalyst is equivalent to the physical blends of Pt with ZnO for the desulfurization of a refractory sulfur type.

TABLE 4

Ring Opening Of Methylcyclohexane Containing 50 wppm Sulfur As 4,6-Diethyldibenzothiophene Methylcyclohexane, 275° C., 400 psig, 7.7 W/H/W, $H_2$/Oil = 6

| | | Conversion, Wt. % @ Hr On Oil | | | Ring Opening Rate[1] @ Hr On Oil | | |
|---|---|---|---|---|---|---|---|
| Example | Catalyst | 50 | 100 | 120 | 50 | 100 | 120 |
| 13 | Pt—Zn + ZnO/Ir | 21.4 | 20.6 | | 14.7 | 14.4 | |
| 14 | Pt—ZnO/Ir | 19.6 | 18.3 | 17.6 | 13.9 | 12.8 | 12.4 |
| 15 | Pt + $ZnAl_2O_4$/Ir | 10.5 | 9.6 | 8.8 | 7.3 | 6.7 | 6.1 |

[1]Ring Opening Rate = mol./g./hr.

EXAMPLE 15

The procedure of Example 9 was followed where a 0.6 wt. % Pt on alumina catalyst was admixed with a hydrogen sulfide sorbent comprising zinc aluminum spinel. The results shown in Table 5 indicate the preservation of ring opening activity with this mixed system.

EXAMPLE 16

The sulfide exchange capacities of four similar hydrotalcites having Mg/Al ratios of about 3 were compared in a surrogate test for hydrogen sulfide scavenging efficiency. Sodium sulfide (0.2 g) was dissolved in 10 ml of water, and 1 g of the hydrotalcite was added. The slurry was stirred at room temperature for 1 hr, and the hydrotalcite was separated by filtration. The filter cake was rinsed with 20 ml of water, which was combined with the filtrate. To the filtrate was added 0.75 g of zinc nitrate in 10 ml of water. The zinc sulfide precipitate was recovered by centrifugation, dried at 120° C. and weighed to determine by difference the sulfide exchanged into the hydrotalcite. Sulfur uptake as a function of crystallite size determined by the (001) peak width at half height is shown below. The smallest hydrotalcite crystals have 20 % greater sulfur capacity demonstrating the need to minimize crystallite size, particularly important in the transition metal substituted form of these materials.

| Hydrotalcite Sample | Sulfur Adsorbed, % | (001) Peak Width |
|---|---|---|
| A | 79 | 1.49° |
| B | 79 | 0.74° |
| C | 80 | 0.85° |
| D | 94 | 2.45° |

EXAMPLE 17

The procedure of Example 6 was followed to prepare a mixed/stacked catalyst bed comprising 0.6 wt. % Pt on alumina and a mixed metal oxide, Zr—Zn—Mn blended in about a 48–28–24 composition by weight, upstream of the Ir ring opening catalyst. This system was evaluated for the ring opening of methylcyclohexane containing 50 wppm sulfur as 4,6-diethyldibenzothiophene. The results in Table 5 establish the retention of stable ring opening activity for an extended period of operation. The test was arbitrarily terminated, and the guard bed was calcined in air at 450° C. for 16 hr, and subsequently reinstalled upstream of the Ir ring opening catalyst. Second cycle activity identical to that in Table 5 was sustained for an extended period.

TABLE 5

Ring Opening Of Methylcyclohexane Containing 50 wppm Sulfur As 4,6-Diethyldibenzothiophene
Methylcyclohexane, 275° C., 400 psig, 7.7 W/H/W, $H_2$/Oil = 6

| | | Conversion, Wt. % @ Hr On Oil | | | Ring Opening Rate[1] @ Hr On Oil | | |
|---|---|---|---|---|---|---|---|
| Example | Catalyst | 50 | 100 | 260 | 50 | 100 | 260 |
| 17 | Pt + Zr—Zn—Mn/Ir | 27.1 | 24.7 | 22.2 | 18.5 | 17.0 | 15.1 |

[1]Ring Opening Rate = mol./g./hr.

PREPARATION OF SATURATED CYCLIC FEEDSTOCK A

An aromatics solvent stream containing primarily $C_{11}$ and $C_{12}$ naphthalenes with an API gravity of 10.0 was hydrogenated over 180 g (250 cc) of a 0.6 wt. % Pt on alumina catalyst. The catalyst was prereduced in flowing hydrogen at 750° F. for 16 hours at atmospheric pressure. The aromatics solvent feedstock was passed over the catalyst at 1800 psig, 550° F., an LHSV of 1 with a hydrogen treat gas rate of 7000 SCF/B. The saturated product had an API gravity of 31.6 and was analyzed to contain less than 0.1 wt. % aromatics and greater than 99 wt. % naphthenes.

EXAMPLE 18

A reactor was charged with the 0.9 wt. % Ir catalyst of Example 1. The saturated cyclic feedstock A described above was spiked to 5 wppm sulfur with 4,6-diethyldibenzothiophene and processed over the catalyst. The course of the ring opening of the saturated naphthenes present in the feed was monitored by measuring the API gravity of the product. Successful conversion of naphthenes to paraffins is accompanied by an increase in gravity, and the stability of the catalyst is reflected in changes in gravity with time on oil. The results of this experiment are found in Table 6. While the Ir catalyst was highly active initially, substantial deactivation due to sulfur poisoning occurred with the catalyst being essentially deactivated around 100 hr on oil.

EXAMPLE 19

A reactor was charged with the Ir ring opening catalyst of Example 1. A sulfur guard bed comprising a catalyst comprised of 0.6 wt. % Pt on alumina and zinc oxide was placed upstream of the Ir catalyst; the three components were layered in the order Pt/ZnO/Ir in a stacked/stacked/stacked bed configuration. The weight ratios of the catalyst bed were 0.8:2.0:4.0. The same feed as in Example 18 was processed over this catalyst system, and product gravity was measured to assess the activity of the Ir catalyst. The results are presented in Table 6. Catalyst activity was effectively maintained on the 5 wppm sulfur feed for about 170 hr on oil. At that point the 4,6-diethyldibenzothiophene content of the feed was increased to give 50 wppm sulfur. As Table 6 indicates, catalyst activity was maintained for about 310 hr, including about 140 hr on the high sulfur feed, at which point the run was arbitrarily terminated. Comparison of Examples 21 and 22 confirms the process of this invention on complex streams and the ability of this process to hydrodesulfurize a highly refractory sulfur compound at mild conditions over a noble metal catalyst.

TABLE 6

Ring Opening Of Saturated Cyclic Feedstock A Containing 5–50 wppm Sulfur As 4,6-Diethyldibenzothiophene
325° C., 650 psig, 3000 SCF/B, 0.5 LHSV

| | | API Gravity @ 5 wppm S @ Hr On Oil | | | API Gravity @ 50 wppm S @ Hr On Oil | | |
|---|---|---|---|---|---|---|---|
| Example | Catalyst | 1 | 56 | 96 | 169 | 289 | 313 |
| 18 | Ir | 35.1 | 34.2 | 32.5 | — | — | — |
| 19 | 0.6 Pt/ZrO/Ir | 35.2 | 35.1 | 34.9 | 34.9 | 34.6 | 34.8 |

EXAMPLE 20

A reactor was charged with a mixed bed of 2.9 g of a 0.6 wt. % Pt on alumina catalyst and 1.7 g of zinc oxide. The mixed catalyst system was used to process a hydrotreated light cat cycle oil with API gravity of 26 containing 5 wppm sulfur and 55 wt. % aromatics. Successful conversion of aromatics to naphthenes is accompanied by an increase in gravity, and the stability of the catalyst is reflected in changes in gravity with time on oil. Product gravity was measured to follow catalyst stability for the integrated hydrodesulfurization and aromatics saturation reactions with time on oil. The results are presented in Table 7 where a high level of activity was sustained for about 140 hr on oil.

EXAMPLE 21

A reactor was charged with a mixed bed of 2.9 g of a 0.6 wt. % Pt on alumina catalyst and 1.7 g of zinc oxide. This bed was placed upstream of the 0.9 wt. % Ir catalyst of Example 1. The mixed/stacked catalyst system was used to process the feed of Example 20. The product gravity and aromatics content were measured to follow catalyst stability for the integrated hydrodesulfurization, aromatics saturation, and ring opening reactions with time on oil. Successful conversion of aromatics to naphthenes, and naphthenes to paraffins is accompanied by an increase in gravity over that observed in Example 20. The results are presented in Table 7 where a high level of activity was sustained for about 140 hr on oil.

EXAMPLE 22

The procedure of Example 21 was followed except the Ir catalyst was admixed with 0.5 g of a 0.9 wt. % Pt on a zeolite with a high silica to alumina ratio co-catalyst; the function of the latter being to promote ring opening activity as defined in the series of patent applications incorporated by reference in the disclosure. The catalyst system was used to process the feed of Example 20. The product gravities listed in Table 7 illustrate sound catalyst performance based on the process of this invention.

EXAMPLE 23

The procedure of Example 18 was followed except that no zinc oxide was admixed with the Pt catalyst. This configuration provides a HDS/ASAT catalyst but no hydrogen sulfide sorbent. The catalyst system was used to process the feed of Example 20. The product gravities and aromatics level listed in Table 7 illustrate retention of aromatics saturation activity but significantly reduced ring opening activity compared to that of Example 21 on the 5 wppm sulfur feed.

TABLE 7

Processing Of Light Cat Cycle Oil Containing 5 wppm Sulfur and 55 Wt. % Aromatics
315° C., 650 psig, 5000 SCF/B $H_2$, 0.75 LHSV (over Pt)

| | | API Gravity @ Hr On Oil | | Wt. % Aromatics @ Hr On Oil |
|---|---|---|---|---|
| Example | Catalyst | 45 | 136 | 136 |
| 20 | Pt + ZnO | 32.8 | 32.9 | 3.3 |
| 21 | Pt + ZnO/Ir | 33.8 | 33.7 | 1.9 |
| 22 | Pt + ZnO/Ir + Pt on acid | 35.6 | 35.5 | 0.4 |
| 23 | Pt/Ir | 33.3 | 33.2 | 2.0 |

EXAMPLE 24

The catalyst system of Example 21 was used to process a second hydrotreated light cat cycle oil with API gravity of 27 containing 60 wppm sulfur and 56 wt. % aromatics. Product gravity was measured to follow catalyst stability for the integrated hydrodesulfurization and aromatics saturation reactions with time on oil. Table 8 shows no loss in catalyst performance when operated on the second, higher sulfur feed.

EXAMPLE 25

The catalyst system of Example 21 was used to process the feed of Example 24. Product gravity was measured to follow catalyst stability for the integrated hydrodesulfurization, aromatics saturation and ring opening reactions with time on oil. Table 8 shows no loss in catalyst performance when operated on the second, higher sulfur feed.

EXAMPLE 26

The catalyst system of Example 22 was used to process the feed of Example 24. Product gravity was measured to follow catalyst stability for the integrated hydrodesulfurization, aromatics saturation and ring opening reactions with time on oil. Table 8 shows no loss in catalyst performance when operated on the second, higher sulfur feed.

EXAMPLE 27

The catalyst system of Example 23 was used to process the feed of Example 24. Product gravity was measured to follow catalyst stability for the integrated hydrodesulfurization and aromatics saturation reactions with time on oil. Table 8 shows inferior performance of this catalyst system on the 60 wppm sulfur feed. This is due to the inability of the system to protect the ring opening activity of the Ir catalyst as well as reduced aromatics saturation activity of both the Pt and Ir catalysts.

TABLE 8

Processing Of Light Cat Cycle Oil Containing 60 wppm Sulfur and 56 Wt. % Aromatics
315° C., 650 psig, 5000 SCF/B $H_2$, 0.75 LHSV (over Pt)

| | | API Gravity @ Hr On Oil | | Wt. % Aromatics @ Hr On Oil |
|---|---|---|---|---|
| Example | Catalyst | 48 | 92 | 92 |
| 24 | Pt + ZnO | 32.8 | 32.8 | 3.4 |
| 25 | Pt + ZnO/Ir | 34.0 | 33.8 | 1.8 |
| 26 | Pt + ZnO/Ir + Pt on acid | 36.1 | 35.6 | 0.4 |
| 27 | Pt/Ir | 32.6 | 32.2 | 8.1 |

EXAMPLE 28

The procedure of Example 6 was followed to prepare a mixed/stacked catalyst bed comprising 0.05 wt. % Ru on alumina commingled with zinc oxide upstream of the Ir ring opening catalyst. This system was evaluated for the ring opening of methylcyclohexane containing 5 wppm sulfur as thiophene and 10 wppm sulfur as 4,6-diethyldibenzothiophene. The results in Table 9 demonstrate that the guard bed comprised of Ru admixed with zinc oxide was totally ineffective for the hydrodesulfurization of the refractory sulfur type and that rapid and complete poisoning of the Ir catalyst resulted. Comparison with results from Example 7 hereof employing a 0.05 wt. % Pt catalyst demonstrate that all Group VIII noble metals are not equivalent for the process of this invention.

TABLE 9

Ring Opening Of Methylcyclohexane Containing 5 wppm Sulfur As Thiophene And 10 wppm Sulfur As 4,6-Diethyldibenzothiophene Methylcyclohexane, 275° C., 400 psig, 7.7 W/H/W, $H_2$/Oil = 6

| | | Conversion, Wt. % @ Hr On Oil | | | Ring Opening Rate[1] @ Hr On Oil | | |
|---|---|---|---|---|---|---|---|
| Example | Catalyst | 5 | 10 | 20 | 5 | 10 | 20 |
| 28 | Ru + ZnO + Ir | 12.9 | 7.6 | 0.6 | 9.0 | 5.4 | 0.5 |
| 7 | Pt + ZnO/Ir | — | 24.2 | 20.9 | — | 18.6 | 16.8 |

[1]Ring Opening Rate = mol./g./hr.

What is claimed is:

1. A process for the desulfurization of condensed ring sulfur heterocyclic compounds and the ring-opening of ring compounds including aromatics and naphthenes, of a petroleum or petrochemical feedstream containing said compounds, which process comprises contacting said stream with a catalyst system comprised of: (a) one or more catalysts comprised of an effective amount of a noble metal selected from the group consisting of Pt, Pd, Ir, Ru, and Rh on an inorganic refractory support; and (b) a hydrogen sulfide sorbent material; at process conditions that favor aromatic hydrogenation and which include temperatures from about 40° C. to 425° C., and pressures from about 100 to 3,000 psig.

2. The process of claim 1 wherein the sulfur level of the said feedstream is less than about 500 wppm.

3. The process of claim 2 wherein there is a first catalyst bed containing a catalyst comprised of a noble metal selected from the group consisting of Pt, Pd, and bimetallics thereof, on a refractory support mixed with a hydrogen sulfide sorbent material; and a second catalyst bed containing a ring-opening catalyst comprised of a noble metal selected from the group consisting of Pt, Pd, Ir, Ru, Rh, and polymetallics thereof, and wherein the concentration of metal on the catalyst of either bed is from about 0.01 to about 3 wt. %.

4. The process of claim 3 wherein there is also an aromatic saturation function on the catalyst of said first bed and wherein the noble metal of the catalyst of the second bed is Ir.

5. The process of claim 1 wherein all of the one or more catalysts and the hydrogen sulfide sorbent a contained in a single mixed bed.

6. The process of claim 5 wherein the temperature is from about 150° C. to about 400° C. and the pressure is from about 100 to 2,200 psig.

7. The process of claim 6 wherein the pressure is from about 100 to 1,000 psig.

8. The process of claim 1 wherein the temperature is from about 150° C. to about 400° C. and the pressure is from about 100 to 2,200 psig.

9. The process of claim 8 wherein the pressure is from about 100 to 1,000 psig.

10. The process of claim 1 wherein a single bed is provided containing composite particles each of which is comprised of the one or more catalysts and the hydrogen sulfide sorbent.

11. The process of claim 1 wherein the catalyst also contains an effective amount of one or more performance enhancing transition metals selected from metals from the group consisting of Re, Cu, Ag, Au, Sn, Mn, and Zn.

12. The process of claim 4 wherein the hydrogen sulfide sorbent material is selected from supported and unsupported metal oxides, spinels, zeolitic materials, and layered double hydroxides.

13. A process for the desulfurization of condensed ring sulfur heterocyclic compounds and the ring-opening of ring compounds including aromatics and naphthenes, of a petroleum or petrochemical feedstream containing said compounds and containing less than about 500 wppm sulfur, which process comprises: (a) hydrodesulfurizing said stream in a first bed of catalyst containing a hydrodesulfurization catalyst comprised of from about 0.01 to 3 wt. % of a noble metal selected from the group consisting of Pt, Pd, and bimetallics thereof on an inorganic refractory support, at process conditions which include temperatures from about 150° C. to 400° C., and pressures from about 100 to 2,200 psig, thereby converting at least a portion of the condensed sulfur compounds to hydrogen sulfide; (b) sorbing said hydrogen sulfide on a hydrogen sulfide sorbent material; and (c) ring opening ring compounds of the treated stream in a second bed of catalyst, which catalyst are comprised of about 0.01 to 3 wt. % of a noble metal selected from the group consisting of Pt, Pd, Ir, Ru, and Rh on an inorganic refractory support, at ring opening conditions that favor aromatic hydrogenation and which include temperatures of 150° C. to about 400° C., and a total pressure of about 100 to 2,200 psig.

14. The process of claim 13 wherein the feedstream contains less than about 200 wppm sulfur and the hydrodesulfurization catalyst is comprised of a noble metal selected from Pt, Pd, and bimetallics thereof on an inorganic refractory support.

15. The process of claim 14 wherein there is provided a first catalyst bed comprised of a mixture of hydrodesulfurization catalyst and hydrogen sulfide sorbent and a second catalyst bed comprised of said ring opening catalyst.

16. The process of claim 13 wherein the metal of the ring-opening catalyst is Ir.

17. The process of claim 15 wherein the metal of the ring opening catalyst is Ir.

18. The process of claim 13 wherein the ring-opening catalyst also contains an effective amount of one or more performance enhancing transition metals selected from the group consisting of Re, Cu, Ag, Au, Sn, Mn, and Zn.

19. The process of claim 13 wherein the inorganic refractory support for the ring-opening catalyst is selected from clays and zeolitic materials and mixtures thereof.

20. The process of claim 19 where the inorganic refractory support is a zeolitic material enriched with one or more metals of Group Ia of the Periodic Table of the Elements.

21. The process of claim 13 wherein the inorganic refractory support of the hydrodesulfurization catalyst is selected from the group consisting of oxides of Al, Si, Mg, B, Ti, Zr, P, and mixtures and cogels thereof.

22. The process of claim 21 wherein the hydrogen sulfide sorbent material is selected from supported and unsupported metal oxides, spinels, zeolitic materials, and layered double hydroxides.

23. The process of claim 22 wherein the hydrogen sulfide sorbent is a metal oxide of metals from Groups IA, IIA, IB, IIB, IIIA, IVA, VB, VIB, VIIB, and VIII of the Periodic Table of the Elements.

24. The process of claim 13 wherein there is provided a first catalyst bed comprised of said hydrodesulfurization catalyst and a second catalyst bed comprised of said ring opening catalyst wherein said hydrogen sulfide sorbent flows through each of said catalyst beds with the feedstream.

25. The process of claim 14 wherein the pressure is from about 100 to 1,000 psig.

* * * * *